US007188377B2

(12) United States Patent
Smith et al.

(10) Patent No.: US 7,188,377 B2
(45) Date of Patent: Mar. 13, 2007

(54) HAND-OPERABLE PUMP

(75) Inventors: Eric C. Smith, 261 N. S.R. 5, Larwill, IN (US) 46764; Steven Stroup, Sr., Fort Wayne, IN (US)

(73) Assignee: Eric C. Smith, Larwill, IN (US)

( * ) Notice: Subject to any disclaimer, the term of this patent is extended or adjusted under 35 U.S.C. 154(b) by 0 days.

(21) Appl. No.: 11/402,780

(22) Filed: Apr. 12, 2006

(65) Prior Publication Data

US 2006/0225193 A1 Oct. 12, 2006

Related U.S. Application Data

(63) Continuation-in-part of application No. 10/814,437, filed on Mar. 30, 2004.

(51) Int. Cl.
*E02D 9/00* (2006.01)

(52) U.S. Cl. ..... 4/255.02; 4/255.03; 4/255.11; 417/437; 417/571

(58) Field of Classification Search .. 4/255.01–255.12; 417/234, 437, 569, 571
See application file for complete search history.

(56) References Cited

U.S. PATENT DOCUMENTS

| | | | | |
|---|---|---|---|---|
| 11,559 A | | 8/1854 | Pease | |
| 86,287 A | | 1/1869 | Dix | |
| 98,422 A | | 12/1869 | Scott | |
| 247,308 A | | 9/1881 | Chewning | |
| 532,985 A | | 1/1895 | McLean | |
| 880,370 A | | 2/1908 | Earl | |
| 952,340 A | | 3/1910 | Murphey | |
| 1,052,033 A | | 2/1913 | Bowser | |
| 1,368,871 A | * | 2/1921 | Wisenant | 137/229 |
| 1,444,596 A | | 2/1923 | Eder | |
| 1,645,788 A | * | 10/1927 | Boies | 417/555.1 |
| 2,129,415 A | | 9/1938 | Fontenot | |
| 2,496,821 A | | 2/1950 | Smith | |
| 5,154,821 A | * | 10/1992 | Reid | 4/490 |
| 5,244,365 A | | 9/1993 | Catcher | |
| 5,649,647 A | | 7/1997 | Kodarar | |
| 5,823,754 A | * | 10/1998 | Lee | 4/255.08 |
| 5,947,706 A | * | 9/1999 | Gapinski | 417/437 |
| 6,035,455 A | | 3/2000 | Rankovic | |
| 6,163,895 A | | 12/2000 | Davenport | |
| 6,638,039 B1 | | 10/2003 | Saxton | |

OTHER PUBLICATIONS

Ace Hardware web page; Master Plunger® (Mp100-1) Item No. 49800; dated Feb. 10, 2004.
Ace Hardware web page; Master Plunger® (Mp1600); Item No. 4195194; dated Feb. 10, 2004.

* cited by examiner

*Primary Examiner*—Tuan Nguyen
(74) *Attorney, Agent, or Firm*—Barnes & Thornburg LLP

(57) ABSTRACT

A pump having a vessel with a hollow interior. An adaptor may be associated with the vessel and include an opening that facilitates selective flow of fluid relative to the interior. A piston may be slidably mounted within the vessel's interior and movable relative to the adaptor. The pump may also include a piston actuator having a first actuator end and a second actuator end in which the first actuator end is operably associated with the piston. The second actuator end may extend outside the interior such that the piston actuator is configured for facilitating selectable movement of the piston within the vessel. A valve assembly selectively attachable to the adaptor to facilitate selective flow of fluid relative to the adaptor.

10 Claims, 8 Drawing Sheets

HAND-OPERABLE PUMP

RELATED APPLICATION

The present application is a continuation-in-part of U.S. patent application Ser. No. 10/814,437, filed on Mar. 30, 2004, entitled HAND-OPERABLE PISTON PLUNGER.

FIELD OF THE INVENTION

The present invention relates to a pump for displacing a fluid. More specifically, the present invention relates to a pump including a plunger assembly that is coupled to a valve assembly to form the pump.

BACKGROUND

Plungers are commonly used for unclogging blocked drains. The basic plunger consists of a rubber suction device mounted on a handle. This basic plunger, while effective for many clogs, has its associated problems. These problems include limited suction power to dislodge clogs and a tendency to displace a high volume of water/fluid, both when first inserted and then during actual plunging action. As a result, splashing and/or overflow of drain liquid/fluid may result. In an attempt to at least increase the available suction power for a plunger, an accordion/bellow section has been added to many versions to increase the change in volume and thereby the amount of pressure which may be generated with the plunger.

There are many circumstances in which the common plunger cannot dislodge the clog within a drain. As a result, there are a series of power plungers which have been developed. Such power plungers generally use a pressurized fluid source or water flow via a pump mechanism to create a positive fluid pressure against the clog. Such power plungers have generally proven to be more effective against tough clogs. However, an obvious potential drawback of such a power plunger is that the addition of more fluid to an already clogged drain may alone cause overflow. Additionally, such power plungers are generally complex in nature and usually require a hookup with another fluid or water source.

What is needed in the art is a hand-operable plunger which is self contained, simple to use, and which is able to create a positive pressurized fluid flow against a clog to thereby increase its effectiveness in dislodging clogs. Also, the hand-operable plunger can be coupled to a valve assembly to form a hand-operable pump for displacing fluid.

SUMMARY

The hand-actuated piston plunger of the present invention is configured to use clog fluid already present in a plumbing unit having a backed-up drain to thereby create a pressurized injection fluid stream to be directed at a clog. The hand-actuated piston plunger can also be coupled to a valve assembly allowing them both, in one illustrative embodiment, to function together as a pump.

The hand-actuated piston plunger of the present invention includes a vessel member, a drain adaptor, a plunger piston, and a piston actuator. Such a plunger may further advantageously be equipped with an actuator handle, a vessel handle, and/or a bellow/accordion arrangement within the vessel member. The vessel member has first and second vessel ends and a hollow vessel interior. The drain adaptor is associated with the first vessel end and includes an adaptor opening which facilitates selective flow of fluid relative to the vessel interior. The piston plunger is slidably mounted within the vessel interior and is movable relative to the drain adaptor. The piston actuator has a first and second end with the first end operably associated with the plunger piston. The second end of the piston actuator extends outside of the vessel interior. This piston actuator can then be used to move the plunger piston within the vessel interior in such a manner so as to selectably either draw clog fluid into the vessel interior or to expel it therefrom. The provision of actuator and/or vessel handles allow for greater control during use of the plunger of the present invention. A bellows/accordion arrangement positioned within the vessel interior and interconnecting the first vessel end and the plunger piston provides for a changeable yet sealed working volume for the clog fluid.

In another illustrative embodiment, a plunger piston can be coupled with a valve assembly to form a pump. The valve assembly includes a body having first and second openings disposed therein. The valve assembly also includes at least first and second valves with each disposed adjacent first and second openings, respectively. The valves are configured to allow fluid flow in only one direction. The body is configured to be coupled to the plunger piston. In this illustrative embodiment, the body includes an extension member connected to the first opening and extending outwardly therefrom. The extension may be placed in a fluid desired to be displaced and then the piston is selectively actuated in an appropriate direction to draw fluid into the pump. The first valve adjacent the first opening is configured to allow fluid to be drawn in, but not to be expelled through the first opening. Once a fluid is drawn into the pump through the first opening, the piston can be actuated in another direction to expel the fluid from the pump. The second valve is configured to allow the fluid to be expelled from the pump through the second opening. The first valve prevents the fluid from exiting through the first opening. An extension member can be coupled to the second opening to further conduct the fluid from the pump before being expelled into the outside environment.

In another illustrative embodiment, flexible tubular members can be coupled to each opening in the valve assembly. These flexible tubular members can be of various lengths to allow placement in a fluid disposed at various distances from the pump and allow the fluid to be expelled remotely from the pump. In another illustrative embodiment the valve assembly is coupled to the piston plunger through an interference fit, allowing the valve assembly to be quickly removed or coupled to the piston plunger. The bellows/accordion arrangement can be used in other illustrative embodiments to change the volume of the piston plunger to vary the amount of fluid to be displaced.

BRIEF DESCRIPTION OF DRAWINGS

The present invention will be described hereafter with reference to the attached drawings which are given as non-limiting examples only, in which.

Figure 3:
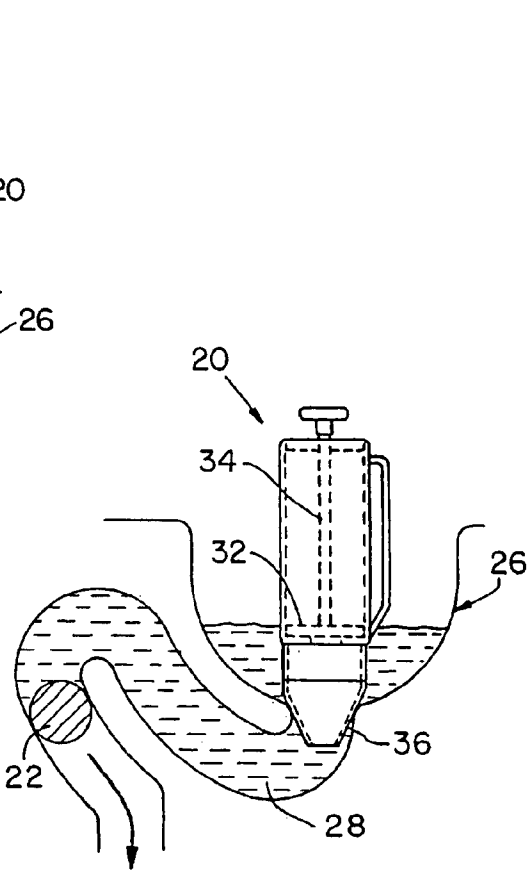
FIGS. 1–3 are schematic sectional views of a first embodiment of the piston plunger of the present invention, illustrating three stages of operation thereof.

Corresponding reference characters indicate corresponding parts throughout the several views. The exemplifications set out herein illustrate at least one preferred embodiment of the present invention in one form, and such exemplifications are not to be construed as limiting the scope of the present invention in any manner.

DETAILED DESCRIPTION OF THE INVENTION

Figure 2:
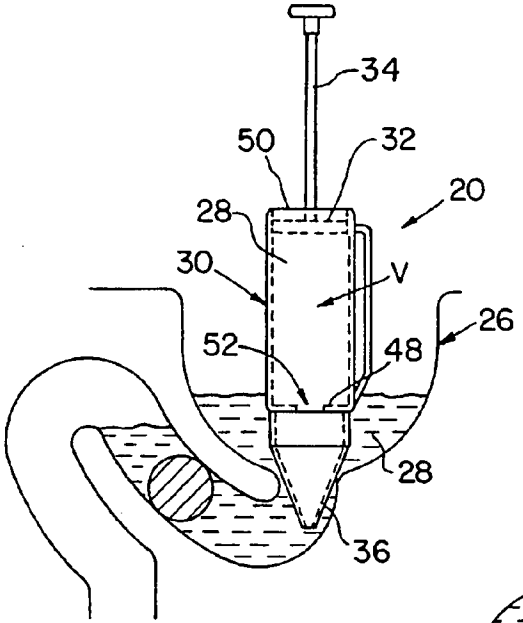
Figure 1:
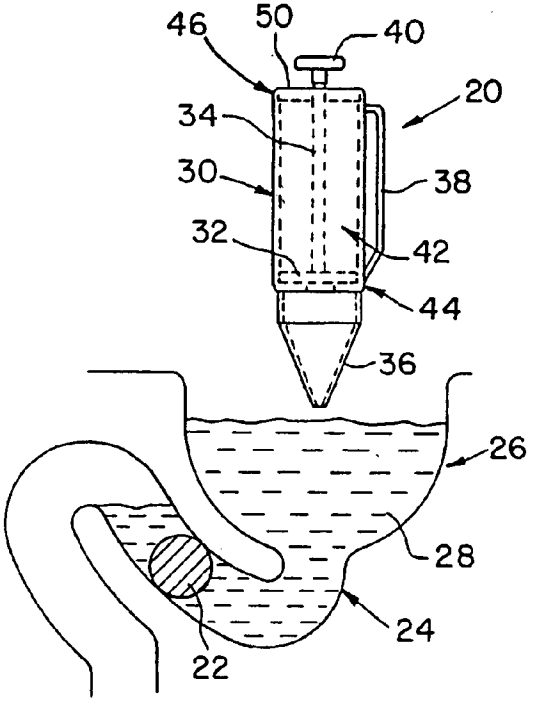

Hand-operable piston plunger 20, illustrated in various stages of operation in FIGS. 1–3, represents a first embodiment of the plunger of the present invention. Hand-operable piston plunger 20 is configured for freeing a clog 22 within the piping/drain 24 associated with a particular plumbing unit 26 (e.g., a toilet or sink) using clog/back-up fluid 28 already collected within plumbing unit 26. Hand-operable piston plunger 20 includes a vessel member 30, a plunger piston 32, a piston actuator 34, a vessel handle 38, and an actuator handle 40.

Vessel member 30 has a vessel interior 42, and through operation of the combination of the plunger piston and piston actuator, it is configured for selectively receiving clog/back-up fluid therewithin. The vessel interior 42 must be large enough to hold a suitable amount of fluid (as best seen in FIG. 2) for the plunging of difficult clogs 22. The vessel member 30 is advantageously made of a plastic material as such materials generally are relatively inexpensive, chemically and mechanically durable, and generally easy to clean. Alternatively, vessel member 30 could be made of a durable, corrosion/rust resistant metal or other material. It is very useful for a vessel member 30 to be made of rust and corrosion resistant material so as to thereby retain, long-term, a smooth surface on the vessel interior 42 to allow for easy piston movement therewithin.

Vessel member 30 further includes a first vessel end 44 and a second vessel end 46. Associated with first vessel end 44 is a first end stop 48, while second vessel end 46 has a second end stop 50 associated therewith. First end stop 48 and second end stop 50 together provide the travel limits for piston 32 within vessel interior 42. First end stop 48 must be supplied with at least one first stop opening 52 to allow fluid communication between drain adaptor 36 and vessel member 30. In this first embodiment, the first end stop 48 is integrally attached to drain adaptor 36 and as such may further be one of integrally or separably attached to first vessel end 44. It is to be understood that first end stop 48 could take the form of a ledge, a pin, a set of pins, or some sort of spider web arrangement connected to first vessel end 44 to provide for the necessary stop feature for end stop 48. As such, first end stop 48 need not necessarily be a part of drain adaptor 36.

Second end stop 50, as shown, is in the form of an end cap which is mechanically releasably attached to second vessel end 46. It is to be understood that other possible configurations for second end stop 50 may be chosen, although not shown as part of this particular embodiment. Specifically, vessel member 30 can be an essentially open container without a lid as long as the function of the second end stop 50 is provided for (i.e., plunger piston 32 is not able to escape from second vessel end 46 during upward operation of piston plunger 32.).

At minimum this limit stop requirement for second end stop 50 could be provided for simply by the presence of an inwardly extending ledge or pin(s) (not shown) at second vessel end 46. However, it is advantageous that second end stop 50 also be able to provide lateral support for piston actuator (plunger shaft) 34 during operation thereof. One means of providing for this feature is for second end stop 50 to have a "spider" arrangement which leaves an appropriate size opening for receiving the plunger shaft/piston actuator therewithin. It is to be understood that the cap version for second end stop 50, as shown in FIGS. 1–3, satisfies this desired support/stability function for second end stop 50.

The plunger piston 32 of the first embodiment, as shown in FIGS. 1–3, is slidably mounted against vessel interior 42. It is important in such an embodiment for plunger piston 32 to retain a seal against vessel interior 42 as well as maintaining a seal therewith during operation. This is such that unwanted leaking of the clog fluid 28 to regions above plunger piston 32 can be avoided, and so that the pressure associated with the operation of piston 32 can be most effectively maintained. It is useful that plunger piston 32 be made of a plastic or polytetrafluoroethalene (PTFE, sold under the trade name Teflon™) or potentially of a corrosion resistant metal.

The material chosen must be able to allow for easy motion of the piston 32 yet maintain an appropriate seal with vessel interior 42. Additionally, such a material must be rust and corrosion resistant since active drying of the vessel interior after use thereof is not always feasible. As such, the vessel interior 42 and plunger piston 32 can be expected to be subjected to exposure to moisture for generally long periods of time after use of the plunger 20. Additionally, the plunger piston 32 should be chemically resistant to most household cleaners, drain opening solutions, and/or disinfectants to which plunger 20 may be exposed, either during use or cleaning thereof.

To provide for a better seal between plunger piston 32 and vessel interior 42, an additional seal member such as an o-ring seal 54 (FIG. 4) may be supplied. Such a seal would better ensure the integrity of the seal between piston 32 and vessel member 30. This is especially true if a metal piston 32 is being employed, since the coefficient of friction associated with a metal piston can be expected to decrease with the formation of any sort of corrosion or any mechanical wear on the surface thereof.

Plunger piston 32, along with vessel interior 42 and first vessel end 44, define a variable fluid volume V within vessel member 30. This volume V will of course be dependent upon the positioning of piston 32. The expansion of volume V via movement of plunger piston 32 toward the second vessel end 46, will draw fluid into the vessel interior 42 via drain adaptor 36. Conversely, the movement of plunger piston 32 toward first vessel end 44 will serve to contract volume V and expel fluid from piston plunger 20. The faster plunger piston 32 is moved, the more force with which fluid (e.g., air, liquid, suspension, etc.) is able to be drawn or expelled.

By having plunger piston 32 positioned adjacent first vessel end 44 prior to insertion of piston plunger 20 into plumbing unit 26 and into clog fluid 28, clog fluid 28 can then be drawn into the vessel interior 42 upon insertion of drain adaptor 36 into clog fluid 28. The volume V of clog fluid 28 within vessel interior 42 can be then increased to its maximum by movement of plunger piston 32 towards second vessel end 46, thereby providing the fluid for use by the piston plunger 20 to free the clog and creating volume space for the insertion of piston plunger 20 into position proximate the piping/drain 24.

Once drain adaptor 36 is appropriately positioned relative to drain 24, piston actuator 34 is pressed forcefully downward. This downward motion causes plunger piston 32 to rapidly expel the clog fluid 28 out of the vessel interior 42 and through drain adaptor 36 and into drain 24. This expelled fluid 28 acts upon the clog 22 and, when successful, provides enough force to cause the clog to free from the piping/drain 24 and thereby allow the entirety of clog fluid 28 to proceed down through drain 24.

Drain adaptor 36 is releasably attached or molded to first vessel end 44. Drain adaptor 36 is configured such that it creates a fluid connection of the vessel interior 42 with the exterior of the piston plunger 20 and allows for a fluid connection to be made with the drain fluid in the plumbing unit 26 and/or drain 24. Drain adaptor 36 is advantageously removably attached for periodic, more vigorous cleaning and to permit replacement thereof is necessary due to air.

There are certain advantages gained by having drain adaptor 36 having a conical or frusto-conical shape. First of all, such a conical shape allows drain adaptor 36 to fit into various diameter drains 24. Thus, it eliminates the need to change adaptors 36 to accommodate different drain sizes. Additionally, the conical shape helps create a venturi nozzle effect during expulsion of clog fluid 28 through the drain adaptor 36, thereby increasing the effective ejection speed which may be achieved.

Drain adaptor 36 is preferably made of rubber or another elastomeric material. By being made of such a material, it aids in the insertion of drain adaptor 36 into a given drain opening. The highly elastic nature of such a material helps to accommodate the forces applied to the adaptor 36 due to the suction and ejection processes. Finally, elastomeric materials are generally reasonably inert and thereby can withstand exposure to a variety of household chemicals, including drain opener chemicals, which may have been added to the clog fluid 28.

Piston actuator 34 connects to plunger piston 32 within vessel interior 42 and extends through second vessel end 46 so as to provide a portion thereof available for actuation by hand. Such a piston actuator 34 is an elongate member that can be made of any of a variety of materials including wood, metal, or plastic. The variety of materials available for use of the piston actuator are more varied than those available for the other portions as the exposure of the piston actuator to clog fluid 28, including any drain cleaner added thereto, is limited since it is placed on the dry side of piston 32. It is important that the material chosen for piston actuator 34 be mechanically durable and strong to obtain an appropriate transfer of mechanical power to piston 32 for effective plunging.

Piston actuator 34 has some significant functional differences when compared to the prior art handle associated with a standard plunger. The standard prior art plunger is affixed on top of a suction member and is arranged so that the first plunging step, once the suction device is entered into the water, is to move the drain-adapting suction device downwardly toward and into contact with drain 24. This first step is different from that for the piston actuator of the 34 of the present invention. Specifically, actuator 34 is intended first to be moved upwardly away from first vessel end 44 in order to draw water into the vessel interior 42. It is not until an appropriate amount of fluid 28 has been drawn into vessel interior 42 that the piston actuator 34 is then forced downwardly toward first vessel end 44 to cause fluid expulsion via the use of plunger piston 32. Additionally in the present invention, the function of piston actuator 34 is solely to move piston 32 relative to vessel interior 42. It is not the function of piston actuator 34 to move drain adaptor 36 into its appropriate location. Instead, drain adaptor 36 is moved using vessel handle 38.

Figure 5:
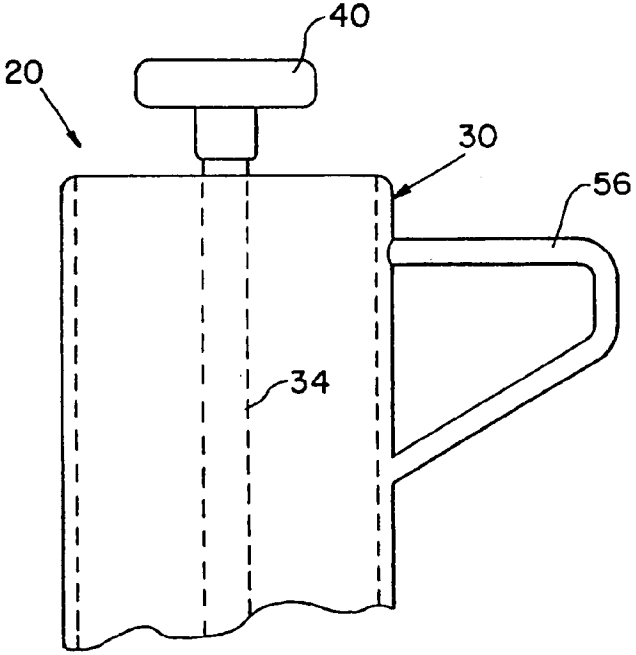
FIG. 5 is a schematic, partial sectional view of a vessel member of the piston plunger of the present invention with the vessel member having a piston positioned there within and having a second embodiment of the vessel handle attached thereto.
Figure 4:
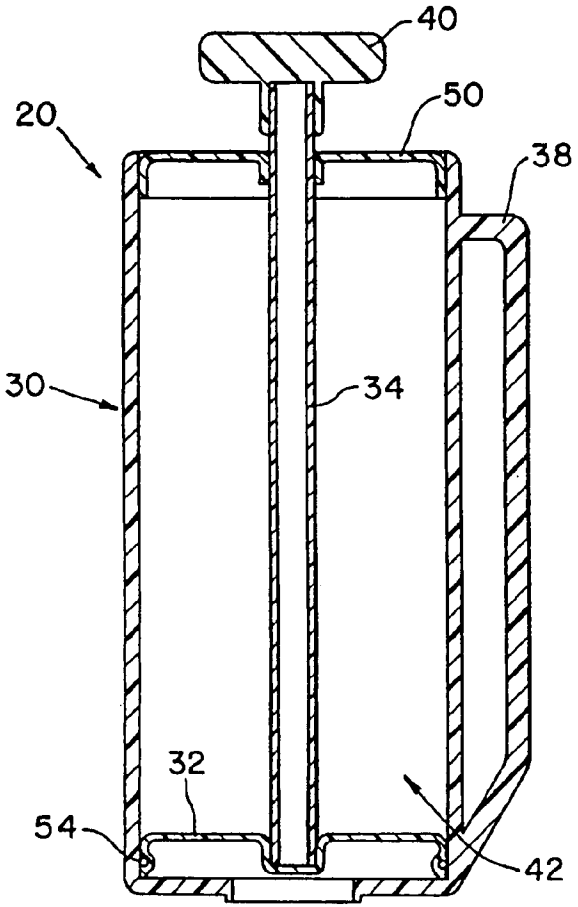
FIG. 4 is a schematic sectional view of the vessel member of the piston plunger of the present invention carrying a piston there within and having a first embodiment of a vessel handle affixed thereto.

FIGS. 4 and 5 help to illustrate two different embodiments for the vessel handle, the first embodiment vessel handle 38, as shown with the embodiment shown in FIGS. 1–3, and the second embodiment vessel handle 56, as illustrated in FIG. 5. Vessel handle 56, shown in FIG. 5, is configured to allow more vertical pressure to be applied to the seal contact area between drain 24 and drain adaptor 36. The longer version for the first embodied handle, vessel handle 38, may prove useful in allowing any of a range gripping positions relative to the length of vessel member 30 to be grabbed by a user, potentially allowing for greater control of the placement of drain adaptor 38 relative to a particular drain 24. This extra length can especially prove useful when using the piston plunger 20 relative to a sink where the clog fluid 28 may not raise such a concern with respect to potential contact therewith. In any event, it is this handle 38, 56 which is used to appropriately locate drain adaptor 36 relative to a drain 24 and to create a sufficient seal between adaptor 36 and that drain 24 to promote an effective plunging operation.

Figure 8:
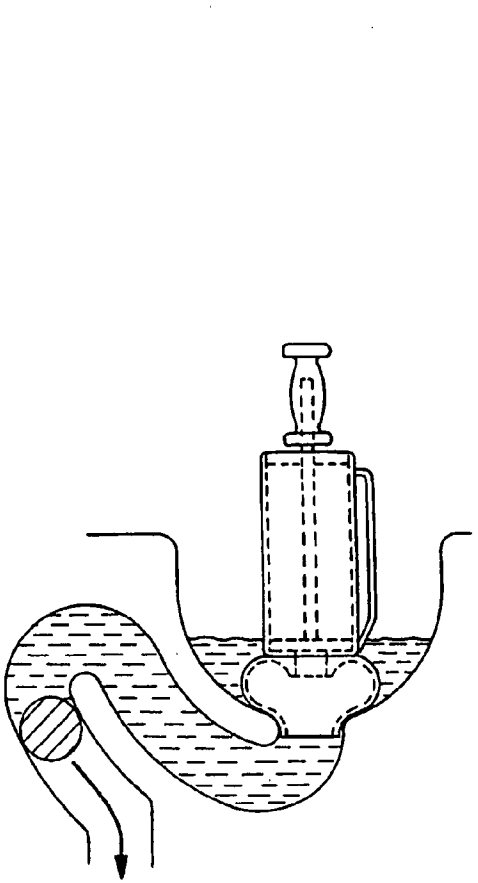
FIG. 6–8 are schematic sectional views of a second embodiment of the piston plunger of the present invention, illustrating three stages of operation thereof.
Figure 7:
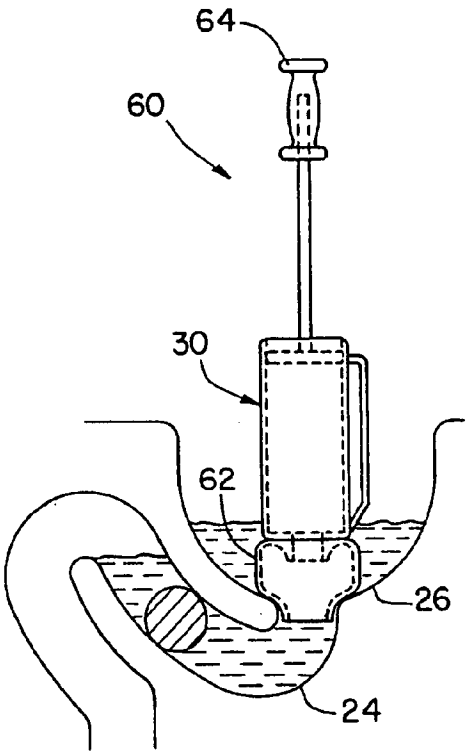
Figure 6:
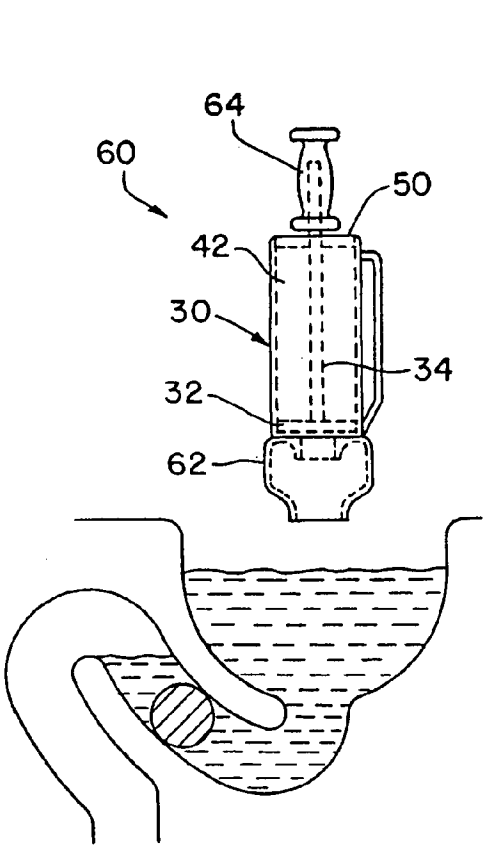

A second embodiment of the piston plunger is illustrated in FIGS. 6–8 in the form of piston plunger 60. Only those portions thereof which differ from the parts presented with respect to piston plunger 20 are labeled differently than the corresponding parts associated with piston plunger 20. Further, it is only those differing parts which are described in detail with respect to piston plunger 60. Additionally, the general method of operation of plunger 60, as indicated in FIGS. 6–8, is essentially the same as that presented for the first embodiment in FIGS. 1–3.

The two primary structural differences related with respect to piston plunger 60 are drain adaptor 62 and actuator handle 64. Drain adaptor 62 is bell shaped in nature and generally provides a wider opening for a positioning proximate drain 24. As such, it is possible for a larger amount of fluid to be taken in or expelled via adaptor 62 at any given time. Additionally, the bell shaped nature of the adaptor 62 provides for a more significant amount of sealing area adjacent drain 24 and plumbing unit 26 than is possible using conical drain adaptor 36 of the first embodiment.

The size and shape of actuator handle 64 offers certain advantages over the simpler actuator handle 40 of the first embodiment. For one, it provides a larger and potentially more ergonomic gripping zone, while still providing a similar grip end that is similar to that associated with actuator handle 40, in the instance that a user may be more comfortable with that style of a grip. Additionally, the handle bar style grip with the wide ends helps to ensure that the handle will be held outside of second vessel end 46 and stopped from entry into vessel interior 42 due to the interaction of handle 64 with second end stop 50.

Figure 10:
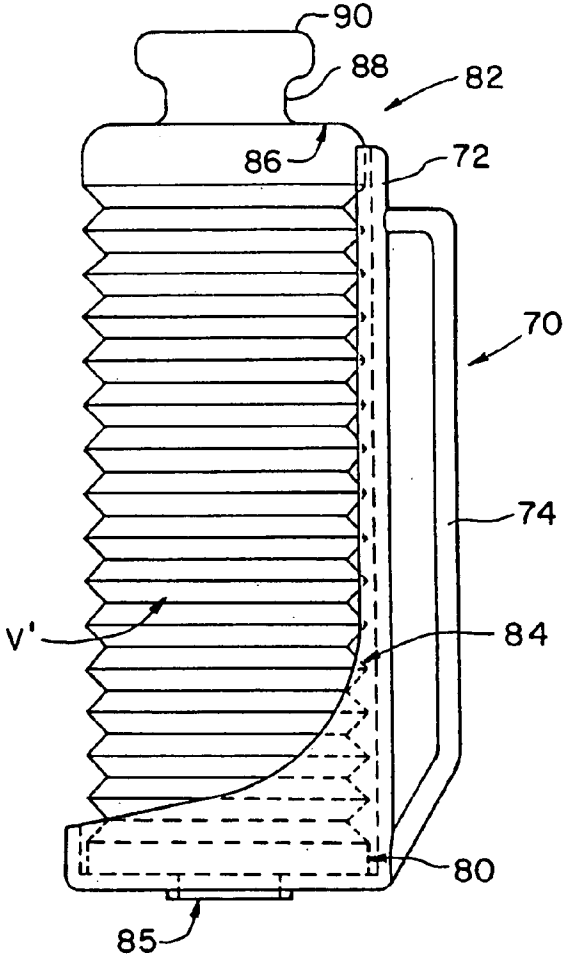
FIG. 9–10 are schematic sectional views of an embodiment of the piston plunger of the present invention which incorporates a bellows/accordion structure therewithin, illustrating the two primary stages of operation thereof.
Figure 9:
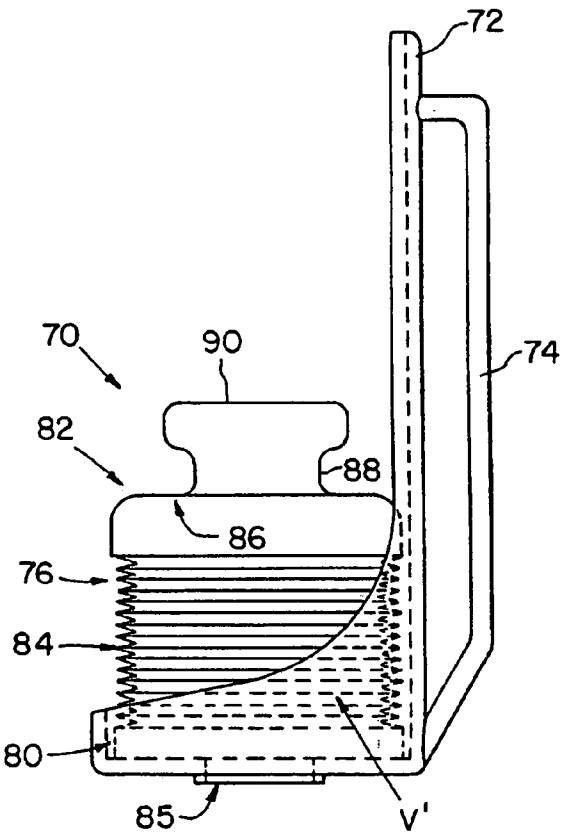

FIGS. 9 and 10 generally illustrate the two stages of use for the third embodiment of the present invention, generally labeled as piston plunger 70. Piston plunger 70 includes a vessel member 72 with a vessel handle 74 affixed thereto and an accordion/bellow structure 76. Accordion/bellow structure 76 has first and second structure ends 80 and 82 and an intermediate folding interconnect portion 84 therebetween. First and second structure ends 80, 82 and folding interconnect 84 thereby define a variable interior volume V' 78 within the accordion/bellow structure 76. First structure end 80 has a first end opening 85 associated therewith to allow fluid connection between accordion/bellow structure 76 and an appropriate drain adaptor (not shown). Accordion/bellow structure 76 is an integral structure such that all of the parts associated therewith are integral with one another. Accordion/bellow structure 76 is ideally formed of an elastomeric material or at least a highly elastic polymeric material to thereby accommodate the compression and extension of the folding interconnect 84.

The second structural end of accordion/bellows structure 76 includes portions which serve the same functional purposes as plunger piston 32, piston actuator 34, and actuator handle 40. Specifically, second structure end 82 effectively includes a piston surface 86, a bellows actuator 88, and a bellows handle 90. The inner surface of second structural end 82 can be considered to be a piston surface 86 as it is this surface which is able to act in a similar manner as the fluid side of plunger piston 32 of the other embodiments, in both the suctioning and the expulsion of a fluid relative to interior volume V'.

The accordion/bellow structure 76 of piston plunger 70, as indicated in FIGS. 9 and 10, is configured such that the expansion of folding interconnect 84 from its compressed version shown in FIG. 9 to its fully expanded version shown in FIG. 10 allows for a change in volume of approximately 0.56 gallons. This volume change thereby represents the approximate potential intake that can be achieved during expansion of interior volume V.

It is to be understood that folding interconnect 84 provides for a built-in piston travel stop for the expansion of the accordion/bellow structure. This is true as folding interconnect 84 is integrally attached to each of first and second structure ends 80, 82. Thus, folding interconnect 84 can be considered to be another appropriate travel stop means relative to the second vessel end.

Figure 11:
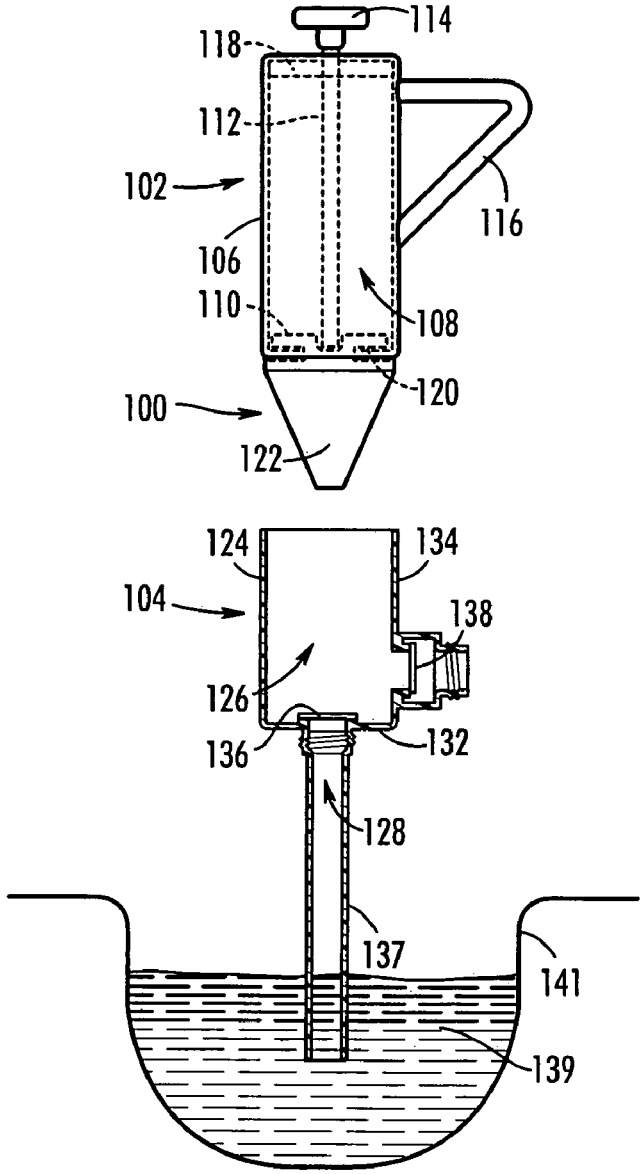
FIG. 11 is a schematic sectional view of an illustrative embodiment of a pump.

FIG. 11 shows a sectional schematic view of an illustrative embodiment of pump 100. Pump 100 includes piston plunger assembly 102 and valve assembly 104. Plunger assembly 102 includes various components similar to that of hand-operable piston plunger 20 shown in FIGS. 1–3. Some of these include vessel 106, which has vessel interior 108, piston 110, piston actuator 112, and actuator handle 114. Vessel handle 116 is coupled to vessel 106. Piston 110 is actuated within vessel 106 by actuator 112 and actuator handle 114. End stops 118, 120 prevent piston 110 from traveling out of vessel 106 during actuation. Plunger assembly 102 also includes adaptor 122, which is similar to drain adaptor 36 shown in FIGS. 1 through 3. Plunger assembly 102 functions in a manner similar to that of plunger 20.

Figure 12:
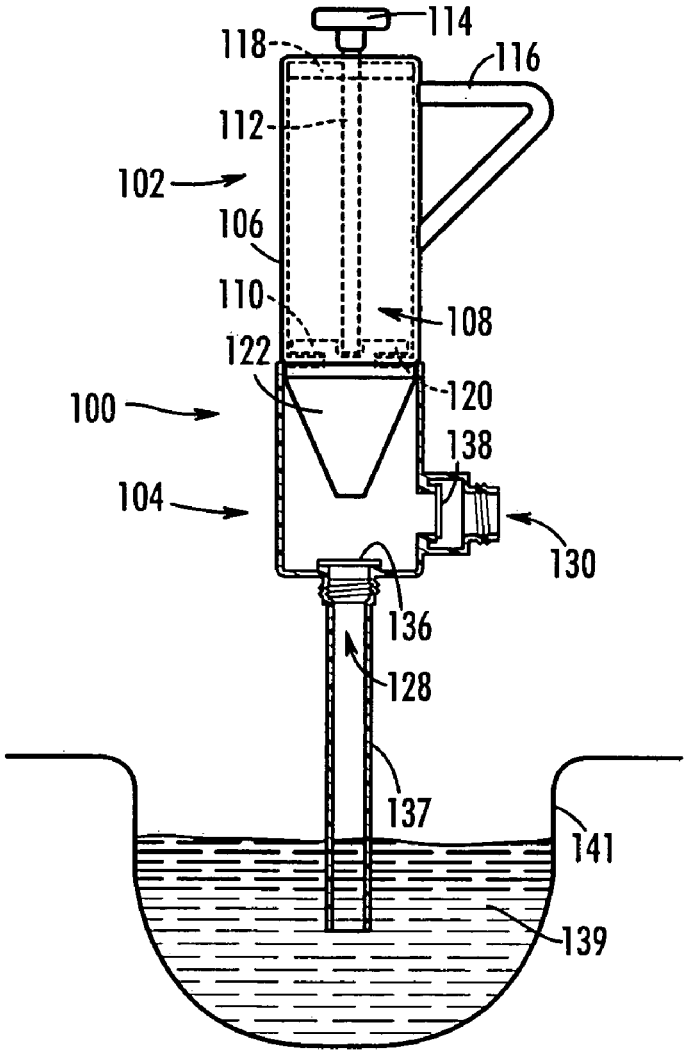
FIG. 12 is another schematic sectional view of the illustrative embodiment of the pump of FIG. 11.
Figure 13:
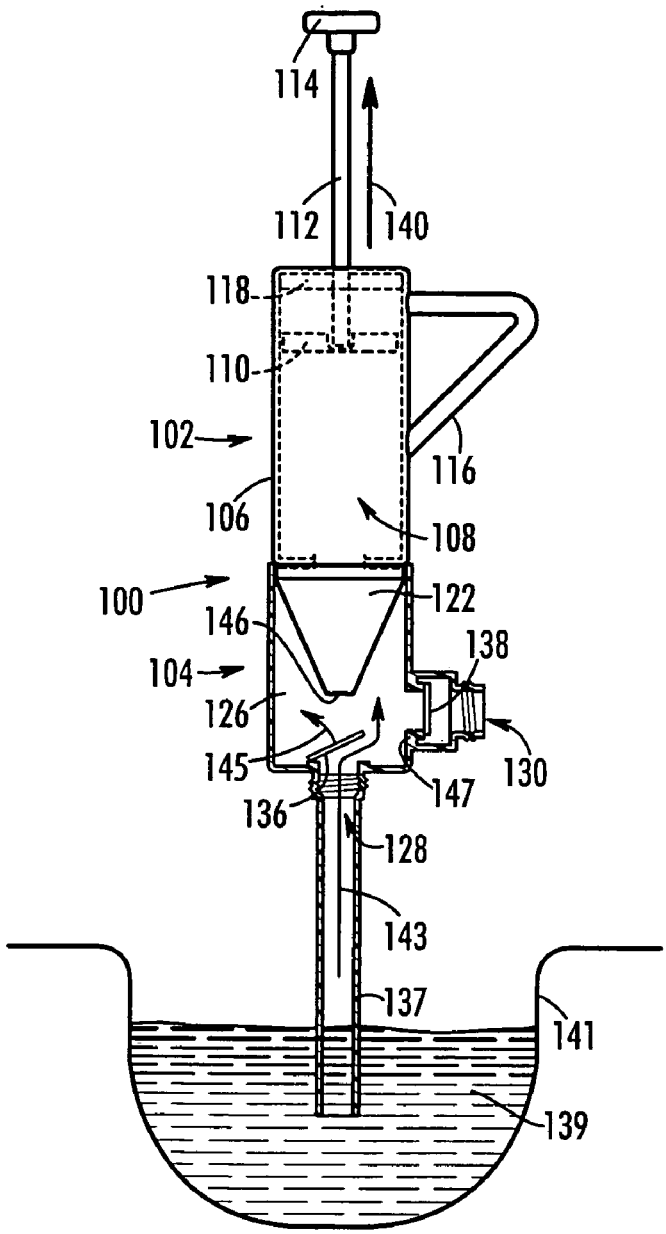
FIG. 13 is another schematic sectional view of the illustrative embodiment of the pump of FIG. 11.
Figure 14:
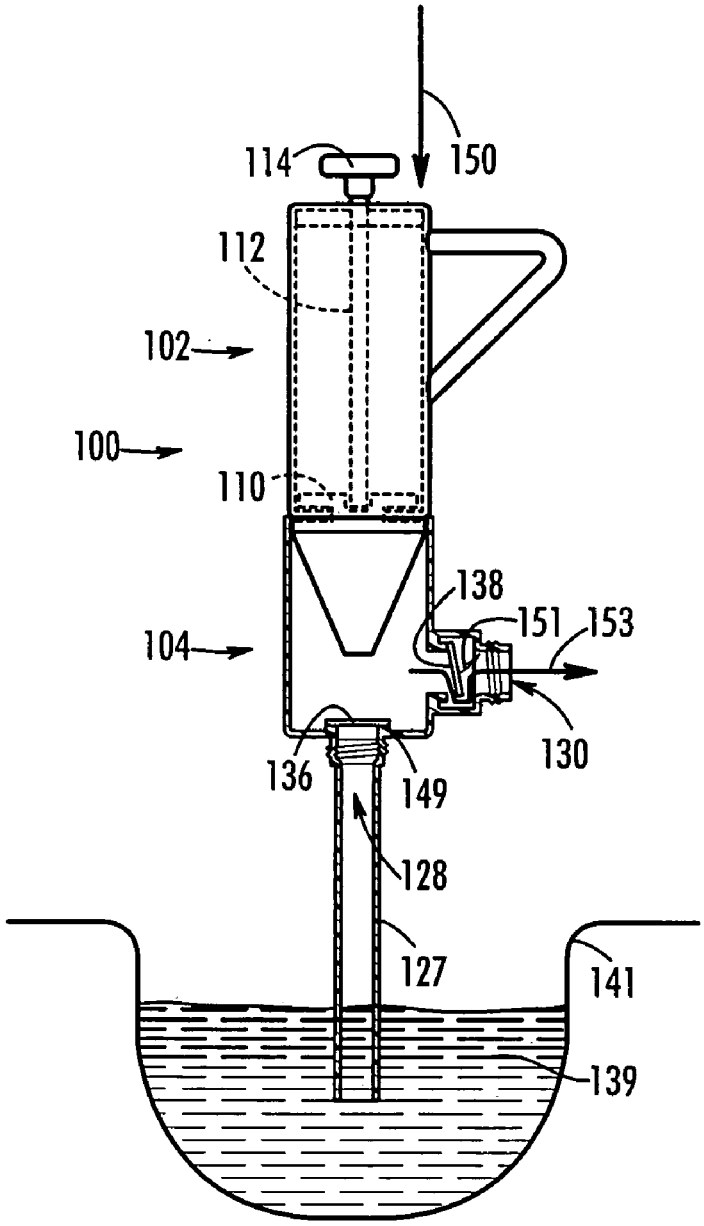
FIG. 14 is another schematic sectional view of the illustrative embodiment of the pump of FIG. 11.

Valve assembly 104 can be coupled to plunger assembly 102 so that assemblies 102, 104 function together as pump 100. The illustrative embodiment of FIGS. 12 through 14 show plunger assembly 102 and valve assembly 104 coupled to one another through an interference fit. As shown in FIG. 11, valve assembly 104 includes cylindrically-shaped body 124. Body 124 includes hollow interior 126. Valve assembly 104 also includes openings 128, 130. In this embodiment, opening 128 is shown to be disposed in bottom 132 of body 124 and opening 130 is disposed through wall member 134 of body 124. Adjacent each opening 128, 130 is disposed a valve 136, 138, respectively.

Valves 136, 138 are configured to allow pump 100 to draw in a fluid, such as fluid 139, through opening 128 and into body 124 and vessel 106 then be expelled through opening 130. As shown in FIG. 11, extension member 137 can be coupled to opening 128 allowing fluid 139 to be drawn therein from receptacle 141. In this illustrative embodiment, extension member 137 is shown to be rigid and tubular in shape, but other types of extension members can be used, such as flexible hoses of various lengths. Opening 130 can be similarly coupled to various types of extension members, such as extension member 137, for example, with the length of the extension member determining how far from body 124 fluid is to be displaced. FIG. 12 shows pump 100 with plunger assembly 102 and valve assembly 104 coupled to one another and in position to draw in fluid.

FIG. 13 shows a sectional schematic view of pump 100 being used to draw fluid therein. Extension member 137 is shown extending into fluid 139. FIG. 13 also shows piston 110, actuator 112, and handle 114 being actuated in direction 140. Piston 110 includes a seal 142 disposed thereon, allowing suction to be created when piston 110 is actuated in direction 140. The suction causes valve 136 to open in direction 145 and fluid 139 is drawn up through extension member 137 and into pump 100 as illustrated by path 143. Fluid 139 moves into body interior 126 continues through adaptor opening 146 into vessel interior 108 while suction is present. Valve 138 is prevented from opening by stop member 147 when fluid is being drawn into pump 100.

Whenever piston 110 is stopped by end stop 118, or a desired amount of fluid is drawn into pump 100, handle 114 may be used to actuate actuator 112 and piston 110 in direction 150 as shown in FIG. 14. When piston 110 is actuated in direction 150, the drawn-in fluid in vessel interior 108 is expelled through adaptor opening 146. Stop member 149 prevents valve 136 from being actuated in a direction opposite direction 145. Valve 138 can only be actuated in direction 153, causing fluid 139 to be expelled through opening 130 along path 153. After expulsion, pump 100 can again draw fluid in through opening 128 through actuation of piston 110 in direction 140 and expel it through opening 130 through actuation of piston 110 in direction 150.

Although the present invention has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A pump comprising:

a vessel having first and second vessel ends, said vessel further including a hollow interior;

an adaptor associated with said first vessel end, said adaptor including an adaptor opening which facilitates selective flow of fluid relative to said interior;

a piston slidably mounted within said interior, said piston being movable relative to said adaptor; and a piston actuator having a first actuator end and a second actuator end, said first actuator end being operably associated with said piston, said second actuator end extending outside of said interior, said piston actuator being configured for facilitating selectable movement of said piston within said vessel; and a valve assembly comprises:

a body having a hollow interior and having first and second openings disposed therein, said body selectively attachable to said adaptor; and first and second valves, said valve assembly is configured to facilitate selective flow of fluid to said adaptor and said interior from said first valve.

2. The pump of claim 1, wherein said body interior and said vessel interior are in communication with one another through said adaptor opening.

3. The pump of claim 1, wherein said first valve allows fluid to be drawn into said pump through said first opening when said piston is actuated in a first direction, and wherein, said second valve allows fluid to exit said pump through said second opening when said piston is actuated in a second direction.

4. The pump of claim 1, wherein said second valve prevents fluid from entering said pump through said second opening when said piston is actuated in said first direction, and wherein, said first valve prevents fluid from exiting said pump through said first opening when said piston moves in said second direction.

5. The pump of claim 1, wherein said valve assembly further comprises first and second tubular members, said first tubular member extending outwardly from said body adjacent said first opening, and said second tubular member extends outwardly from said body adjacent said second opening.

6. The pump of claim 1, wherein said body is selectively attachable to said adaptor through an interference fit.

7. The pump of claim 6, wherein said body is complimentarily formed with said adaptor to provide said interference fit.

8. The pump of claim 1, wherein said adaptor is one of conically shaped, frustoconically shaped, and bell shaped.

9. The pump of claim 1, further comprising a bellows member positioned within said vessel interior and interconnecting said first vessel end and said piston.

10. The pump of claim 9, wherein said piston, said bellows member, and said first vessel end together define a sealed, variable fluid volume in said vessel member, said variable fluid volume being dependent upon a positioning of said piston.

* * * * *